United States Patent [19]

Thomas et al.

[11] Patent Number: 4,929,039

[45] Date of Patent: May 29, 1990

[54] TOOTHBRUSH CABINET FOR HOLDING OF TOOTHBRUSHES AND TOOTHPASTE IN BATHROOM

[76] Inventors: Paul Thomas, 271 Hanakapiai St.; Lionel M. Ahina, 1096-D Wainiha St., both of Honolulu, Hi. 96825

[21] Appl. No.: 271,668

[22] Filed: Nov. 16, 1988

[51] Int. Cl.[5] ..... A47B 75/00

[52] U.S. Cl. ..... 312/213; 312/207; 312/245

[58] Field of Search ..... 312/206, 207, 213, 245

[56] References Cited

U.S. PATENT DOCUMENTS

| | | | |
|---|---|---|---|
| 457,270 | 8/1891 | Griffiths | 312/206 X |
| 1,199,523 | 9/1916 | Bosworth | 312/245 |
| 1,205,311 | 11/1916 | Wybaillie | 312/207 |
| 2,148,043 | 2/1939 | Zero | 312/206 |
| 2,450,626 | 10/1948 | Beilock | 312/206 |
| 2,608,294 | 8/1952 | Ward | 312/206 X |
| 3,228,737 | 1/1966 | Kipnis | 312/245 |
| 4,211,455 | 7/1982 | Tedrow | 312/198 |
| 4,241,963 | 12/1980 | Seidel | 312/207 X |
| 4,566,597 | 1/1986 | Caputo et al. | 312/206 X |
| 4,763,570 | 8/1988 | Cibulak | 312/245 |

*Primary Examiner*—Joseph Falk

[57] ABSTRACT

A cabinet that provides sanitary storage of toothbrushes and convenient storage of toothpaste. Provides storage for toothbrushes free from insects and dust as the cabinet door closes tight and the only openings in the cabinet are one-sixteenth inch diameter vent holes for air circulation so toothbrushes can dry. Sanitary as each toothbrush is raised one-eighth inch above the shelf by its holder ring and toothbrushes do not touch each other for separate and thorough drying. Easy to use as you need only one hand to open the door and readily remove or insert toothbrushes and close the door. The cabinet may be free-standing or attachable to a wall mount and easily removed. Easy to disassemble cabinet for thorough cleaning. Toothpaste holders may easily be attached to each side of the cabinet by snapping on or off. Toothpaste tube stands in the holder.

1 Claim, 8 Drawing Sheets

Figure 13
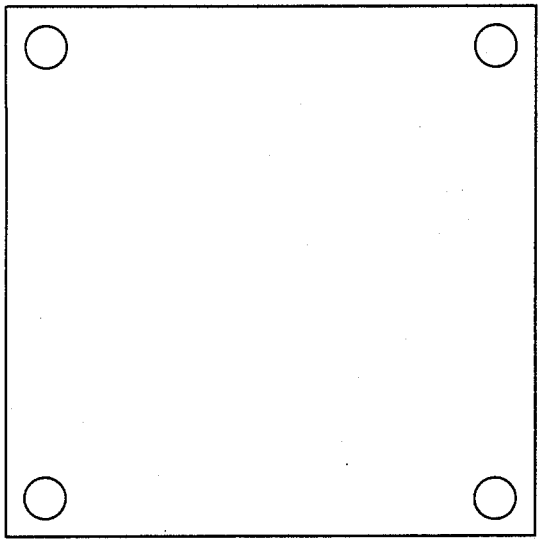
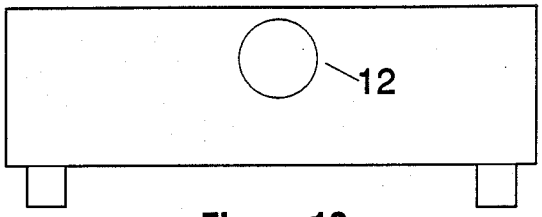
Figure 16
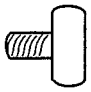
Figure 17
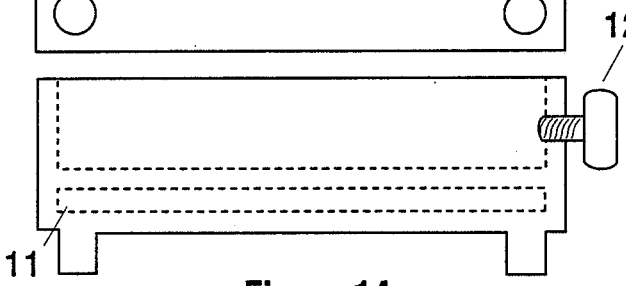
Figure 14
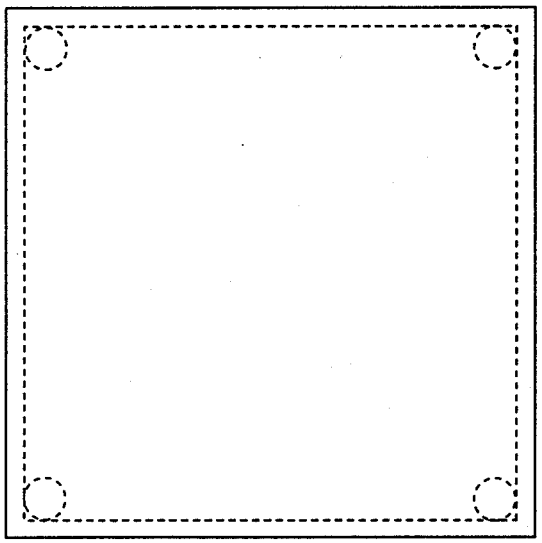
Figure 15
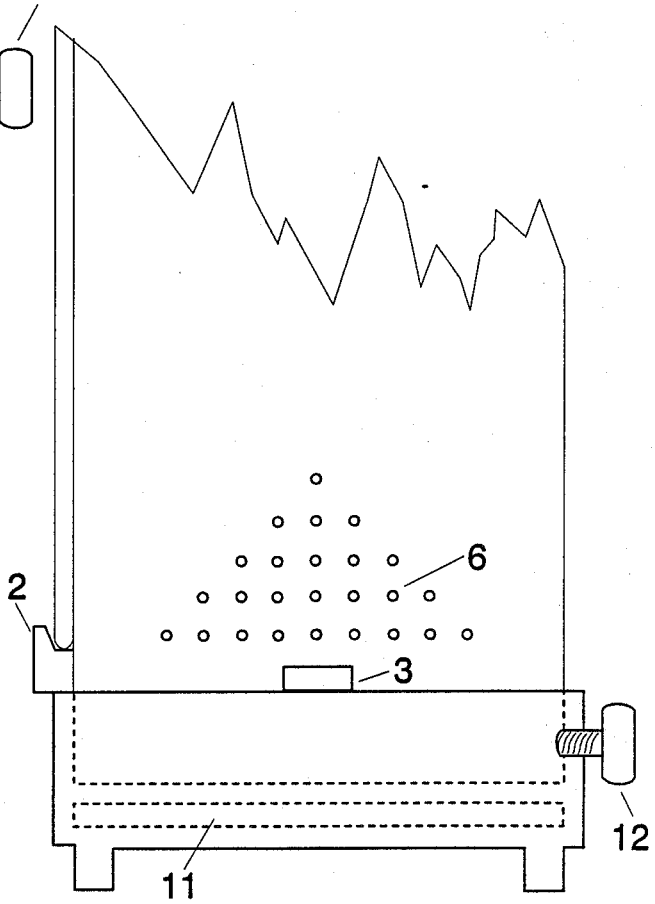
Figure 18

TOOTHBRUSH CABINET FOR HOLDING OF TOOTHBRUSHES AND TOOTHPASTE IN BATHROOM

BACKGROUND

1. FIELD OF INVENTION

This invention relates to toothbrushes and toothpaste holding and use of in the bath room.

2. DESCRIPTION OF PRIOR ART

Many, if not most bathroom toothbrush holders are permanently attached to the wall. This makes them difficult to clean. The toothbrushes are exposed to dust and bugs which is unsanitary. You need both hands to use some holders.

Most users, therefore, would find it desirable to have a toothbrush holder that is bug proof, sanitary, easy to clean and use.

OBJECTS AND ADVANTAGES

Accordingly we claim the following as our objects and advantages of the invention: to provide a bathroom toothbrush holder cabinet that is bug proof, sanitary, easy to clean and use. Bug proof as cabinet door closes tight and the only openings in the cabinet are one-sixteenth inch diameter holes for ventilation so toothbrushes can dry. Sanitary as toothbrushes do not touch each other or their drippings, as each toothbrush is raised one-eight inch above the shelf by its holder ring. Cleaning is easy with mild soap and water. To disassemble and remove from the wall for cleaning: First open door and remove toothbrushes, second slide door and holder assembly up until the two door stops come out of the two notches in the cabinet, door and holder assembly is now removed from the cabinet. Third, slide cabinet up about one half inch until it stops, then out to remove from the wall plate. Easy to use as you need only one hand. Open cabinet door. It remains open with the toothbrush holder out of the cabinet for removal of toothbrush. Replace toothbrush and close cabinet door.

In addition we claim the following additional objects and advantages: Toothpaste holders may easily be attached to each side of the cabinet by snapping on or off. Toothpaste tube stands in holder. Holder for toothbrush cabinet free standing table top use is available. Holder has four one fourth inch long rubber covered legs for no skid.

Readers will find further objects and advantages of the invention from a consideration of the ensuing description and the accompanying drawings. Scale of the drawings is one inch equals one inch or actual size. This cabinet is for six toothbrushes. A cabinet for two, four, six, or eight toothbrushes can be manufactured by varying the depth of the cabinet and holder assembly.

DRAWING FIGURES:

FIG. 13 shows bottom view of free standing holder for toothbrush cabinet.

FIG. 14 shows side view of free standing holder.

FIG. 15 shows top view of free standing holder.

FIG. 16 shows rear view of free standing holder.

FIG. 17 shows side view of lock screw knob.

FIG. 18 shows side view of cabinet standing in holder.

DETAILED DESCRIPTION OF THE PREFERRED EMBODIMENT

Figure 1:
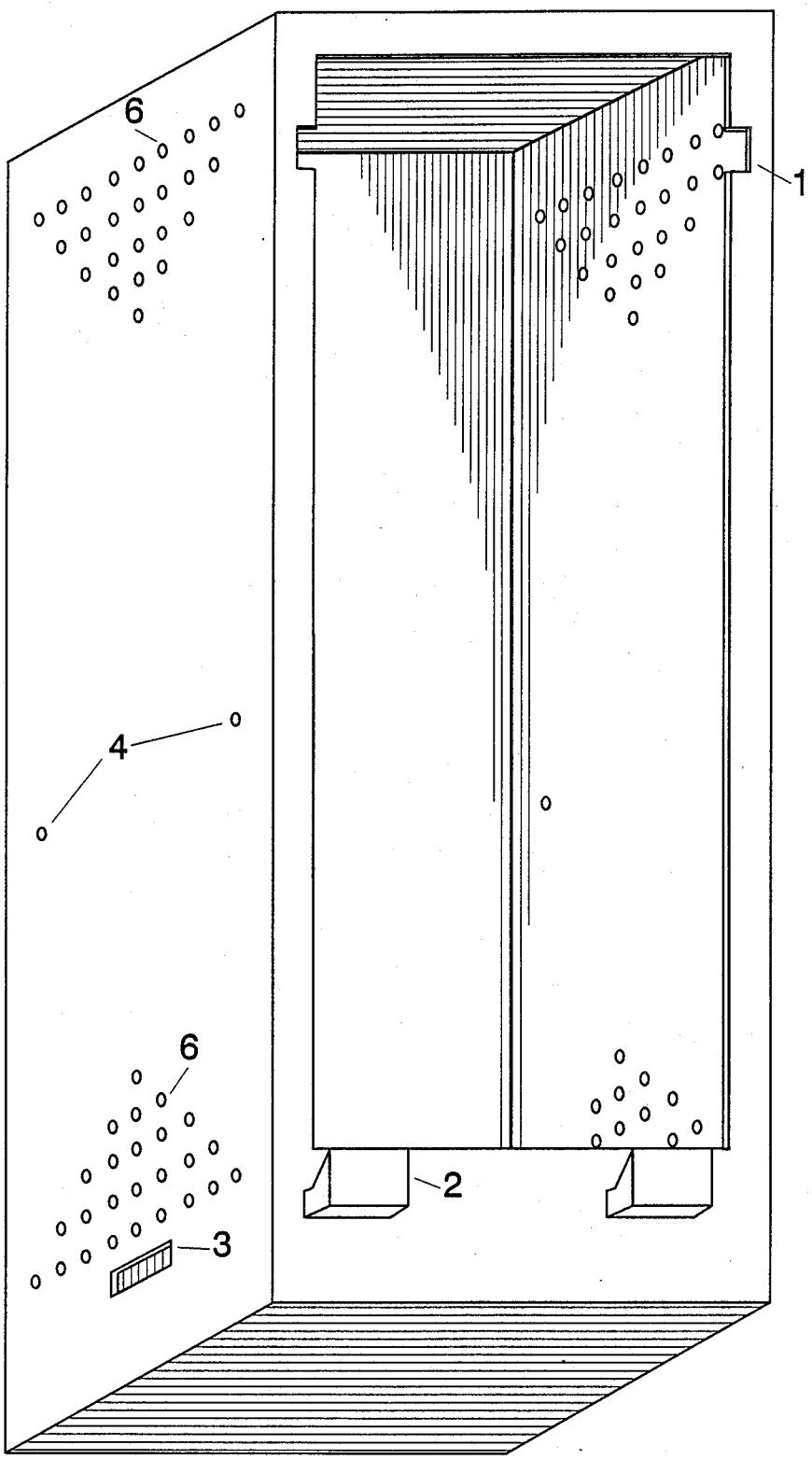
FIG. 1 shows a left side, front, and bottom view of the cabinet.
Figure 2:
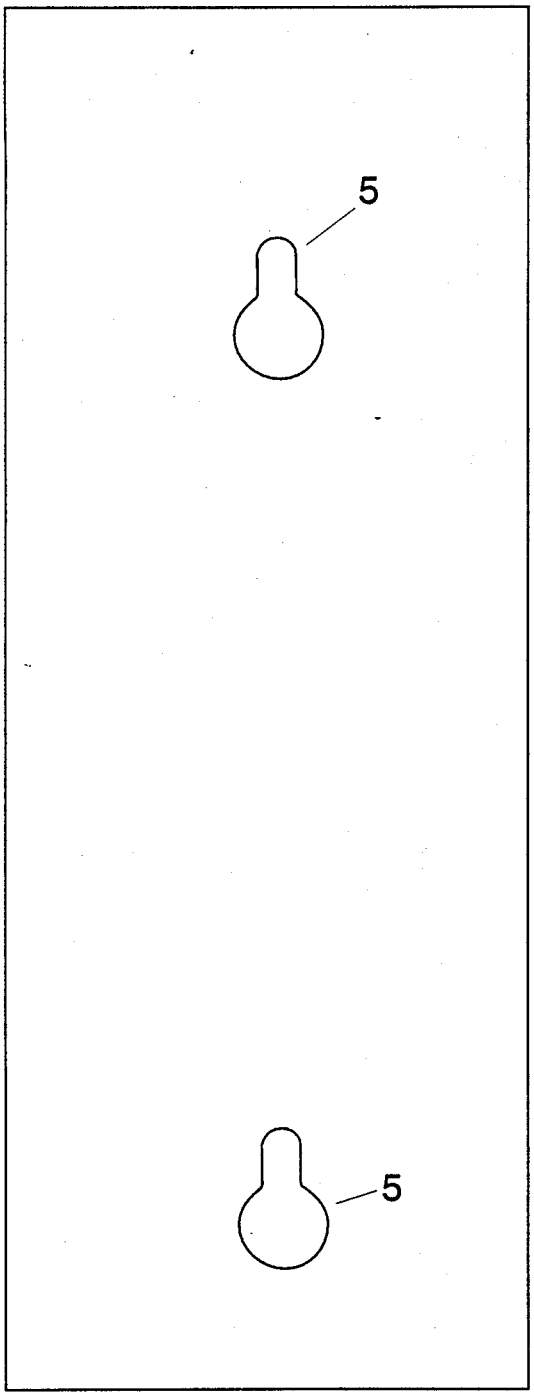
FIG. 2 shows a back view of the cabinet.
Figure 3:
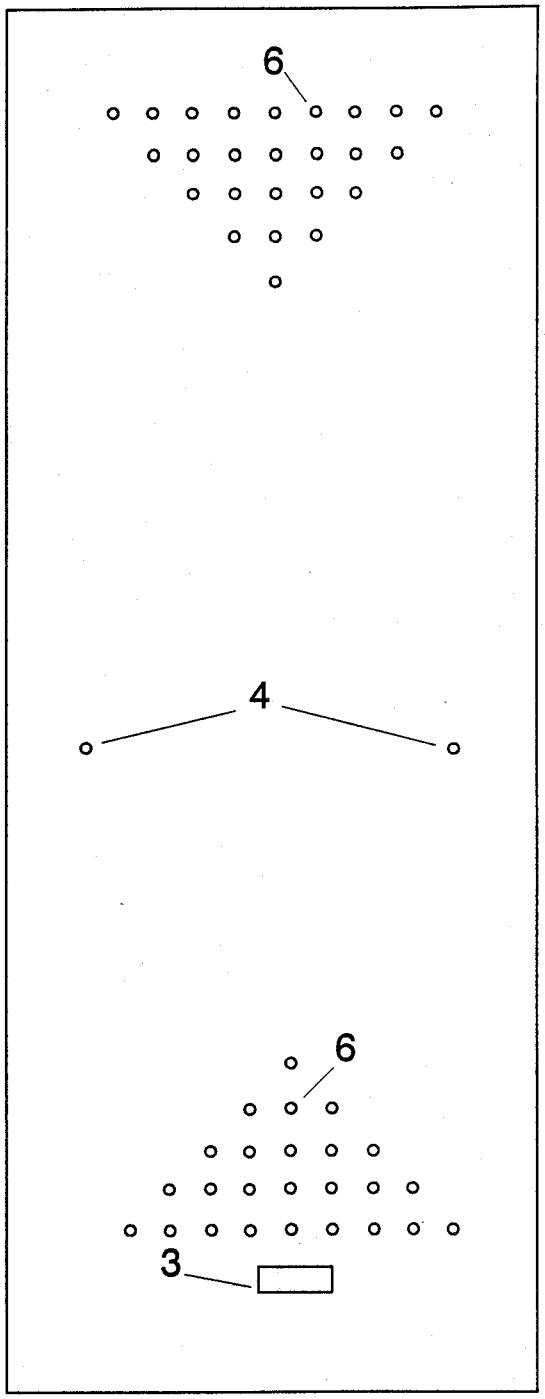
FIG. 3 shows a right side of the cabinet

Referring to the drawings in greater detail, and by reference characters thereto, the cabinet as shown in FIG. 1, 2, and 3, has a pair of side walls with a plurality of ventilation openings 6, a top wall, a bottom wall, and a front wall having an opening. The balance of front wall would normally comprise a door with a shelf connected to the door and extending into the cabinet. The cabinet can be adapted to be used as a wall mounted cabinet or a free-standing cabinet.

Figure 4:
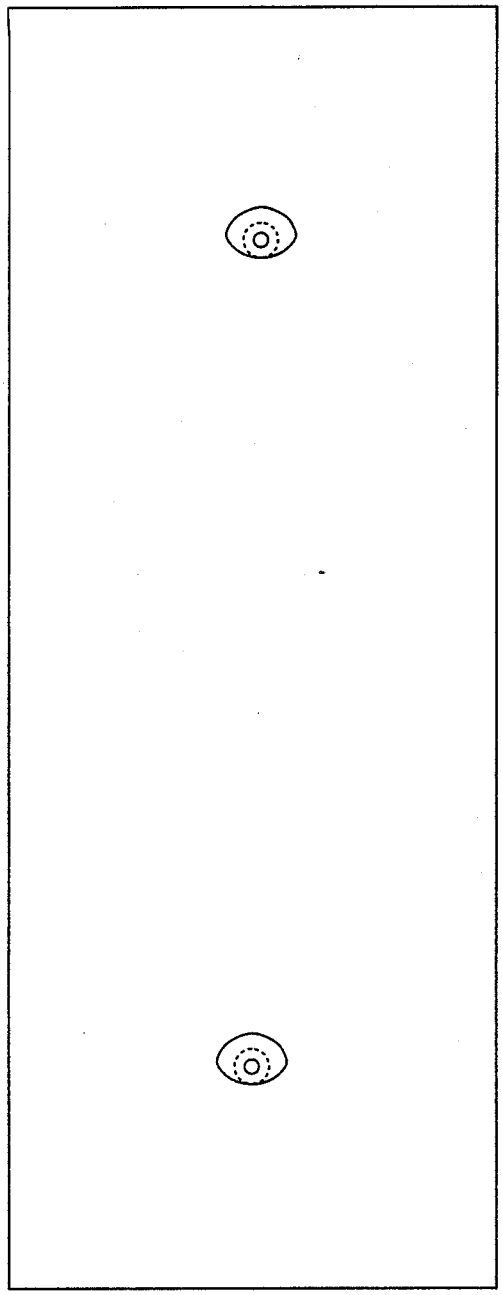
FIG. 4 shows a front view of the cabinet wall mounting plate.
Figure 5:
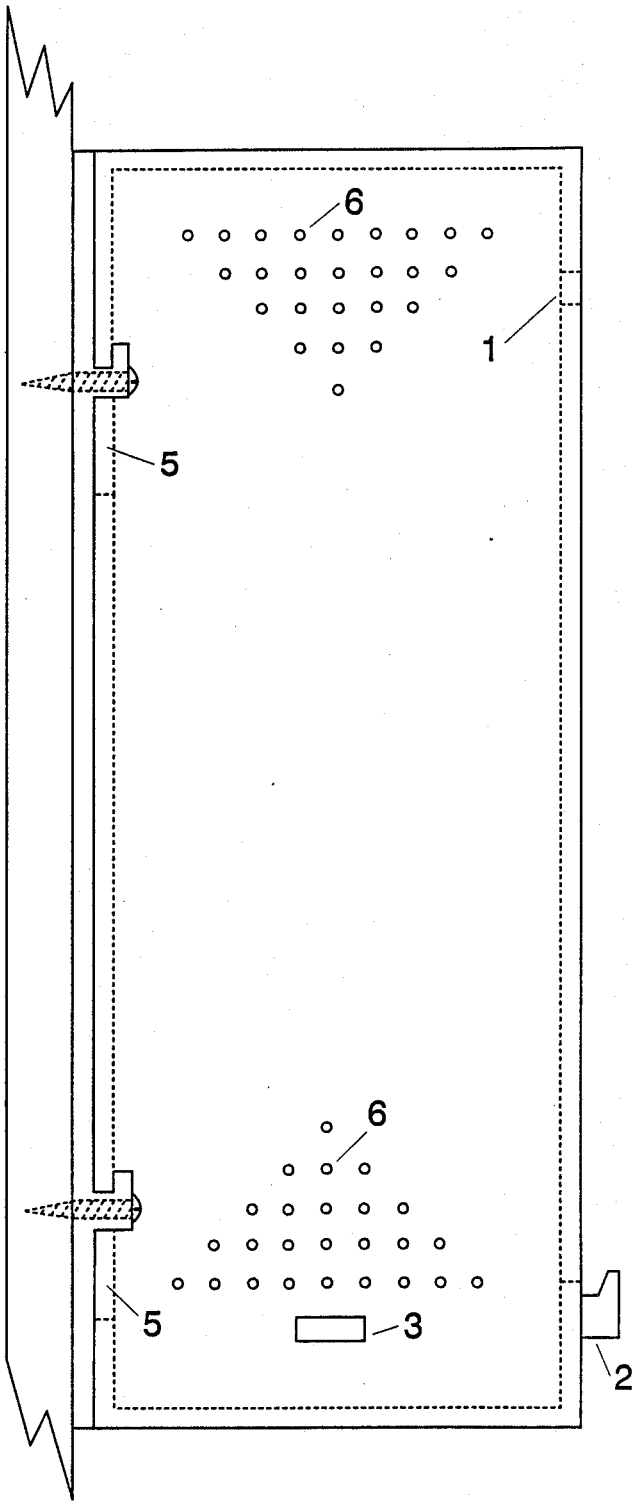
FIG. 5 shows a side view of the wall mounting plate attached to wall, and cabinet attached to mounting plate.

FIG. 5 illustrates the mounting plate for attaching the cabinet to a wall. As may be seen from FIG. 2, the back wall of the cabinet has apertures 5 corresponding in number to the number of hooks projecting from the front face of the mounting plate FIG. 4 to secure the cabinet to the mounting plate attached to the wall.

Figures 6, 7:
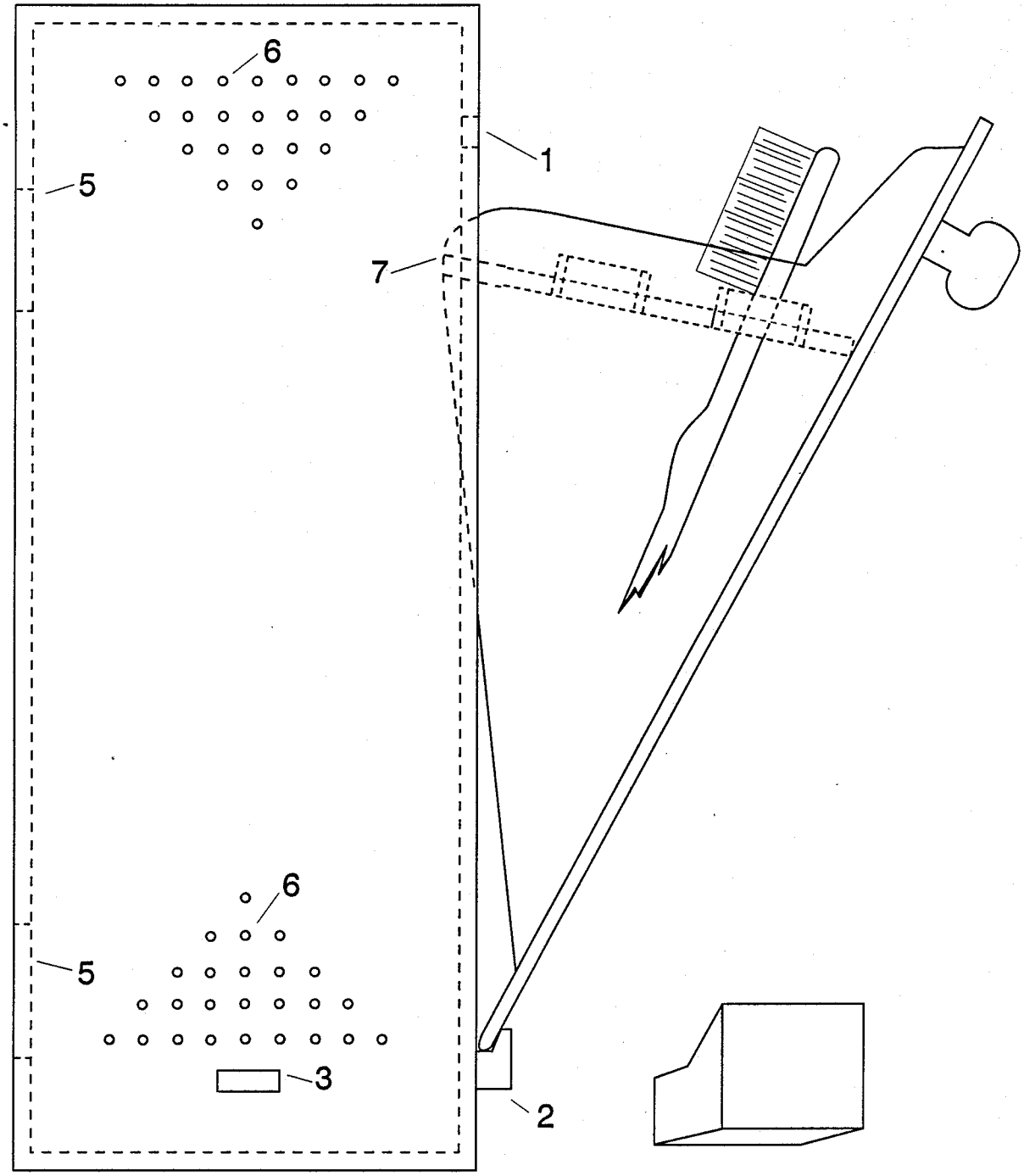
FIG. 6 shows a side view of the holder assembly and door in open position.
FIG. 7 shows front and end view of holder hinges for bottom of the door. Scale is enlarged for a better view.
Figure 8:
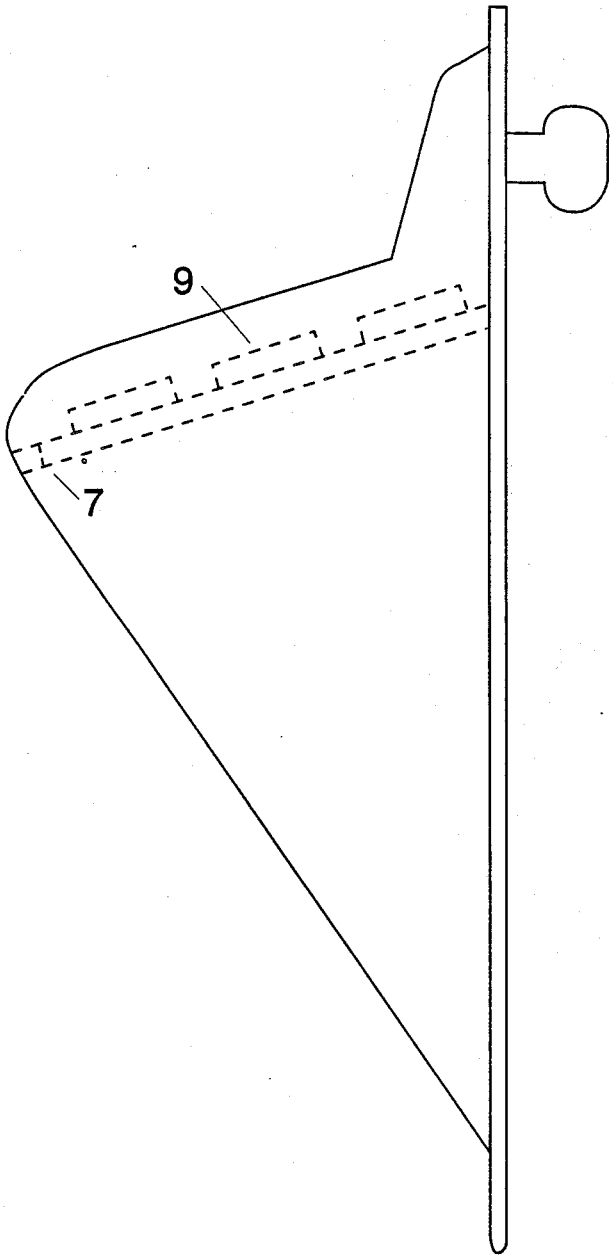
FIG. 8 shows holder assembly and door side view.
Figure 9:
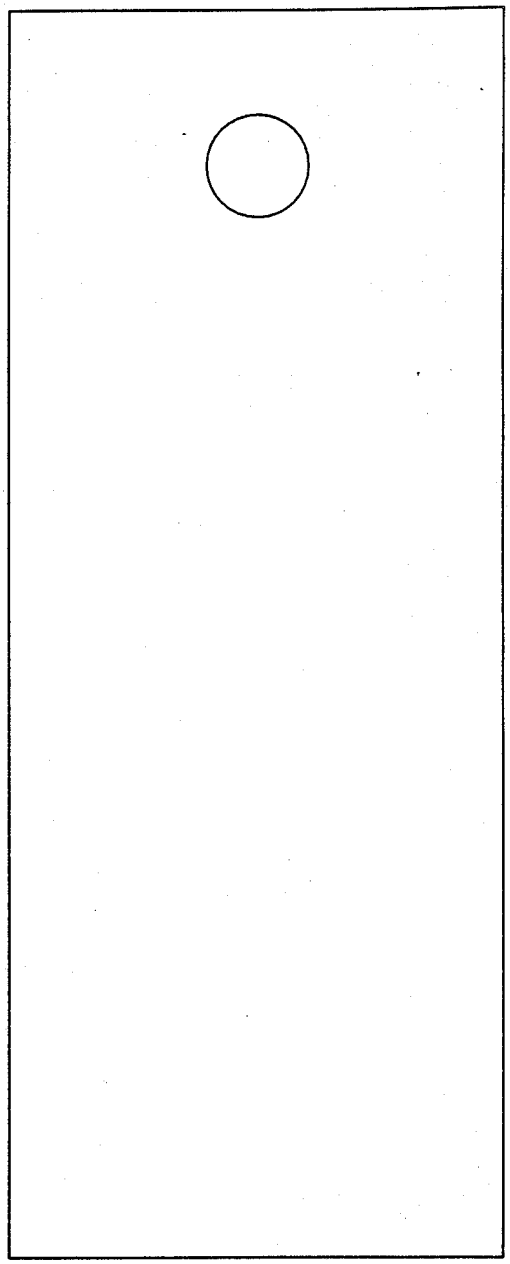
FIG. 9 shows door front view.

FIG. 1 front view and FIG. 6 side view of the cabinet illustrate a pair of upwardly projecting hinge members 2 attached to the lower extremity of the opening of the front wall. The hinge members as shown in FIG. 7 each have a first horizontal portion and a second rearwardly inclined portion adapted to pivotably support a door. The bottom of the door resting on the hinge members provides a means to allow the door to pivot with respect to the cabinet. The shelf connected to the door has stop means 7 located at the side opposite the side connected to the door to engage the cabinet for stopping the door from pivoting too far as shown in FIG. 6. FIG. 6 shows the door in open position. FIG. 9 shows the front view of the door as would normally be seen when the door is in the closed position. Notches 1 and 8 located at the upper extremity of the opening in the front wall allow the stop means to pass to remove or install the door with the shelf which may be desirable at certain times for cleaning.

Figure 10:
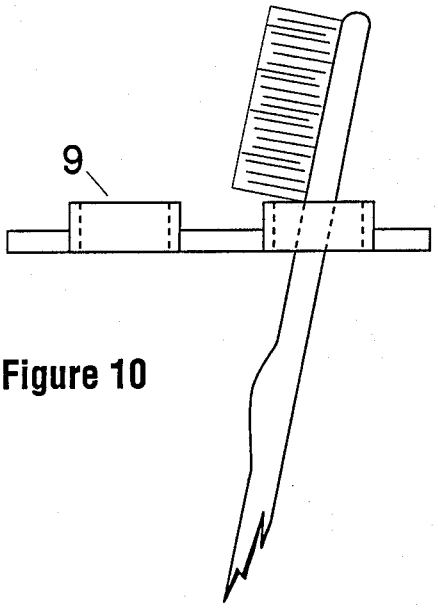
FIG. 10 shows toothbrush in holder assembly.
Figure 11:
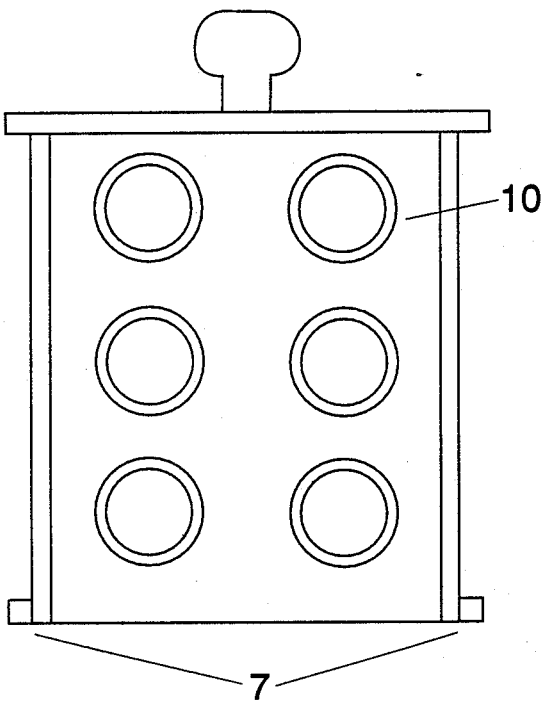
FIG. 11 shows top view of holder assembly shelf.
Figure 12:
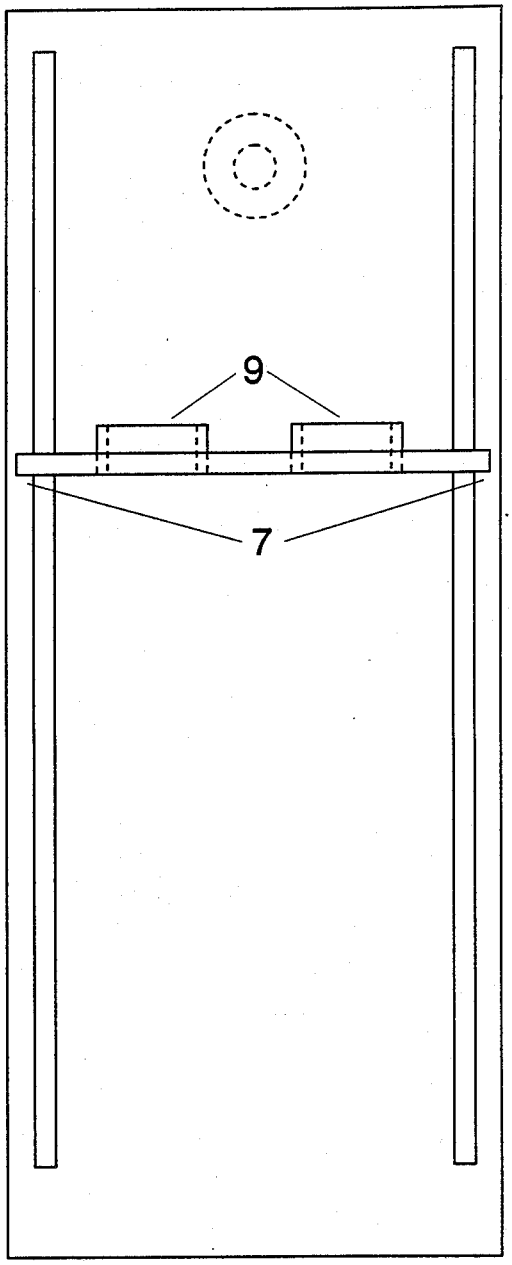
FIG. 12 shows rear view of door and holder assembly.
Figure 19:
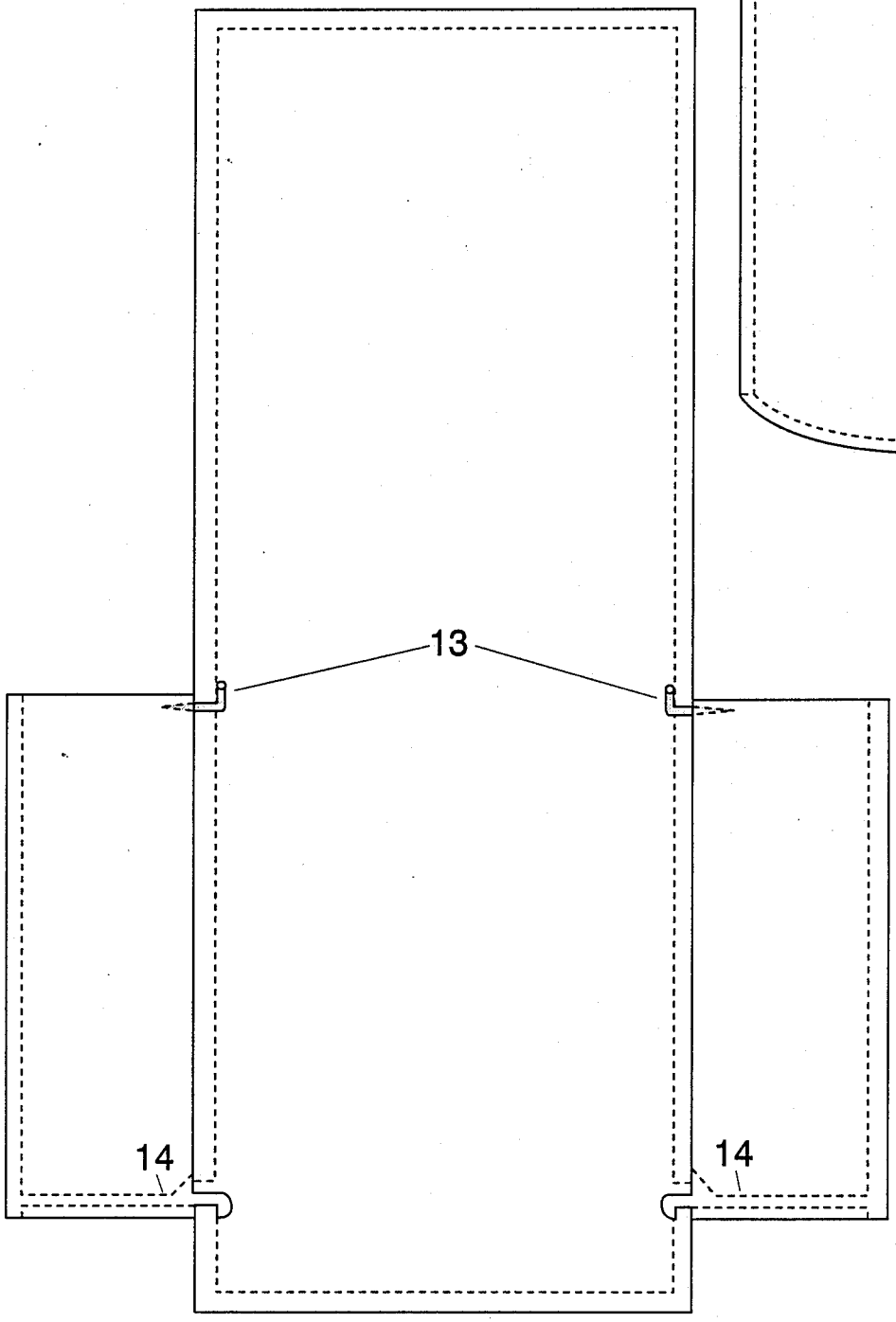
FIG. 19 shows front view of cabinet with toothpaste holders attached.
Figure 20:
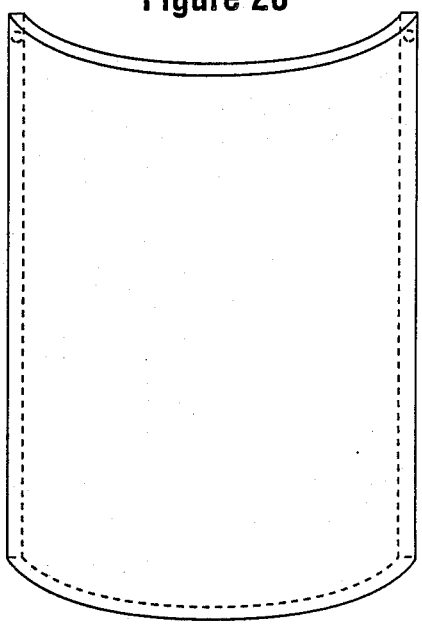
FIG. 20 shows rear view of toothpaste holder.
Figure 21:
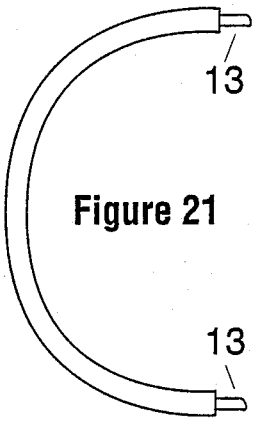
FIG. 21 shows top view of toothpaste holder.
Figure 22:
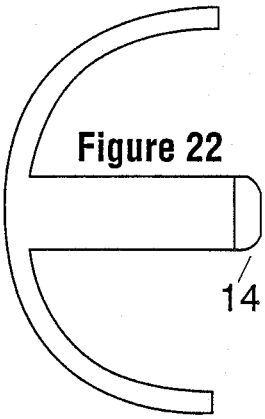
FIG. 22 shows bottom view of toothpaste holder.

The shelf which connects to the door as illustrated in FIGS. 10, 11, and 12, has a plurality of upwardly projecting 9 circular lugs 10 that surround apertures to support and raise toothbrushes approximately one-eighth inch above the shelf.

FIGS. 19, 20, 21, and 22, illustrate the toothpaste holding receptacle. The side walls of the cabinet have a plurality of removable plugs 3 to secure the bottom and latch 14 of the toothpaste holding receptacle after removal of the plugs and a plurality of apertures 4 to receive and engage the metal holder hooks 13 to secure the top of the toothpaste holding receptacle. It may be desirable at certain times to eliminate the toothpaste holding receptacle and the removable plugs 3 would remain in position.

FIG. 18 illustrates the cabinet standing in the free-standing holder which has a lead sheet 11 encased in it. The lock screw knob 12 secures the cabinet to the free-standing holder.

We claim:

1. A wall mountable cabinet for holding toothbrushes comprising:

A mounting plate having front and rear faces and means for attaching to a wall extending from the rear face and at least two hooks projecting outwardly and upwardly from the front face;

A cabinet having a pair of side walls, a top wall, a bottom wall, a back wall, and a front wall having an opening;

Said back wall having apertures corresponding in number to the number of hooks projecting from the front face of the mounting plate, said hooks and apertures cooperating to support the cabinet;

A pair of upwardly projecting hinge members attached to a lower extremity of the opening in the front wall, said hinge members each having a first horizontal portion and a second rearwardly inclined portion, said hinge members adapted to pivotably support a door;

A door, for closing the open front, said door having a bottom resting on the hinge members, providing means to allow the door to pivot with respect to the cabinet;

Shelf means connected to said door and extending into said cabinet, said shelf having a plurality of upwardly projecting circular lugs that surround apertures and provide structure capable of supporting toothbrushes;

Said shelf means having stop means located at the side opposite the side connected to the door, said stop means adapted to engage the cabinet for stopping the door from pivoting too far;

Said side walls having ventilation openings and a plurality of removable plugs;

And a toothpaste holding receptacle which may be secured to the cabinet after removal of the removable plugs.

* * * * *